US008976028B2

(12) United States Patent
Caporizzo

(10) Patent No.: US 8,976,028 B2
(45) Date of Patent: Mar. 10, 2015

(54) APPARATUS AND METHOD OF USING A COMPUTING DEVICE TO TRACK ITEMS

(75) Inventor: Louis Caporizzo, North Wales, PA (US)

(73) Assignee: OKKOLA Technologies, LLC, North Wales, PA (US)

( * ) Notice: Subject to any disclaimer, the term of this patent is extended or adjusted under 35 U.S.C. 154(b) by 255 days.

(21) Appl. No.: 13/433,684

(22) Filed: Mar. 29, 2012

(65) Prior Publication Data

US 2013/0015971 A1 Jan. 17, 2013

Related U.S. Application Data

(60) Provisional application No. 61/508,127, filed on Jul. 15, 2011.

(51) Int. Cl.
*G08B 13/14* (2006.01)
*G08B 21/02* (2006.01)

(52) U.S. Cl.
CPC ..... *G08B 13/1427* (2013.01); *G08B 21/0227* (2013.01); *G08B 21/0236* (2013.01); *G08B 21/0238* (2013.01); *G08B 21/0277* (2013.01); *G08B 21/0294* (2013.01)
USPC ..... 340/572.1; 340/568.1; 340/571; 340/505

(58) Field of Classification Search
USPC ..... 340/586.1, 586.6, 571, 572.1, 505, 340/10.1, 10.5
See application file for complete search history.

(56) References Cited

U.S. PATENT DOCUMENTS

| | | | | |
|---|---|---|---|---|
| 7,187,936 | B2 * | 3/2007 | Allyn et al. | 455/456.2 |
| 7,209,075 | B2 * | 4/2007 | Durst et al. | 342/357.55 |
| 8,094,011 | B2 * | 1/2012 | Faris et al. | 340/539.13 |
| 2003/0034887 | A1 * | 2/2003 | Crabtree et al. | 340/539 |
| 2005/0186968 | A1 * | 8/2005 | Durst et al. | 455/456.1 |
| 2006/0145830 | A1 * | 7/2006 | Comstock | 340/505 |
| 2006/0145850 | A1 * | 7/2006 | Krstulich | 340/572.1 |
| 2007/0268130 | A1 * | 11/2007 | Yee et al. | 340/540 |
| 2007/0279220 | A1 * | 12/2007 | Wilcox | 340/539.32 |
| 2009/0113329 | A1 * | 4/2009 | Corona | 715/769 |
| 2010/0039266 | A1 * | 2/2010 | Faris et al. | 340/572.4 |
| 2011/0084807 | A1 * | 4/2011 | Logan et al. | 340/10.1 |
| 2011/0086632 | A1 * | 4/2011 | Tumey et al. | 455/421 |

* cited by examiner

*Primary Examiner* — Travis Hunnings
(74) *Attorney, Agent, or Firm* — Volpe and Koenig, P.C.

(57) ABSTRACT

A system and method for tracking items are disclosed. The system and method include a computing device capable of near filed communication (NFC), and at least one tag coupled to each of at least one item, where the at least one tag is communicatively coupled to the NFC of the computing device using radio frequency (RF) signals. The coupling of the at least one tag to the at least one item enables the computing device to identify the at least one item and the distance from the at least one item to the computing device.

27 Claims, 6 Drawing Sheets

APPARATUS AND METHOD OF USING A COMPUTING DEVICE TO TRACK ITEMS

CROSS REFERENCE TO RELATED APPLICATION

This application claims the benefit of U.S. Provisional Application No. 61/508,127, filed Jul. 15, 2011, which is incorporated by reference as if fully set forth.

FIELD OF INVENTION

The present invention is directed to an apparatus and method of using a computing device to track items.

BACKGROUND

People constantly lose and misplace their keys, wallet, and other items. People also often leave the house and leave their keys, wallets, and other items inadvertently at home. People also hide things of value, such as sporting tickets, in their house with plans to recover these things at a later time, such as recovering tickets for each game on the day of the game. Often these hidden items may be lost, as the person that hid them forgets where the items were placed.

Thus, there exists a need for an apparatus, system and method that allows for the tracking, monitoring, and finding of keys, wallet, and other items.

SUMMARY

A system and method for tracking at least one item are disclosed. The system and method include a computing device capable of near field communication (NFC), and at least one tag coupled to each of the at least one item, where the at least one tag is communicatively coupled to the NFC of the computing device using radio frequency (RF) signals. The coupling of the at least one tag to the at least one item enables the computing device to identify the at least one item and the distance from the at least one item to the computing device.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts.

DETAILED DESCRIPTION OF THE PREFERRED EMBODIMENTS

It is to be understood that the figures and descriptions of the present invention have been simplified to illustrate elements that are relevant for a clear understanding of the present invention, while eliminating, for the purpose of clarity, many other elements found in radio frequency identification (RFID) and/or computing device systems. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Radio-frequency identification (RFID) and a computing device utilizing near field communication (NFC) and global positioning system (GPS) may be utilized to track objects of interest to a user of the computing device. A tracking application may be downloaded to the computing device, RFID tags may be secured on the items of interest that a user desires to be tracked and the computing device may track the items and assure that the items are within a pre-determined distance of the computing device. If the distance of one of the tags becomes greater than a pre-determined working distance and/or goes beyond the range of the reader, an alarm may be generated by the computing device to alert the user of the condition.

Figure 1:
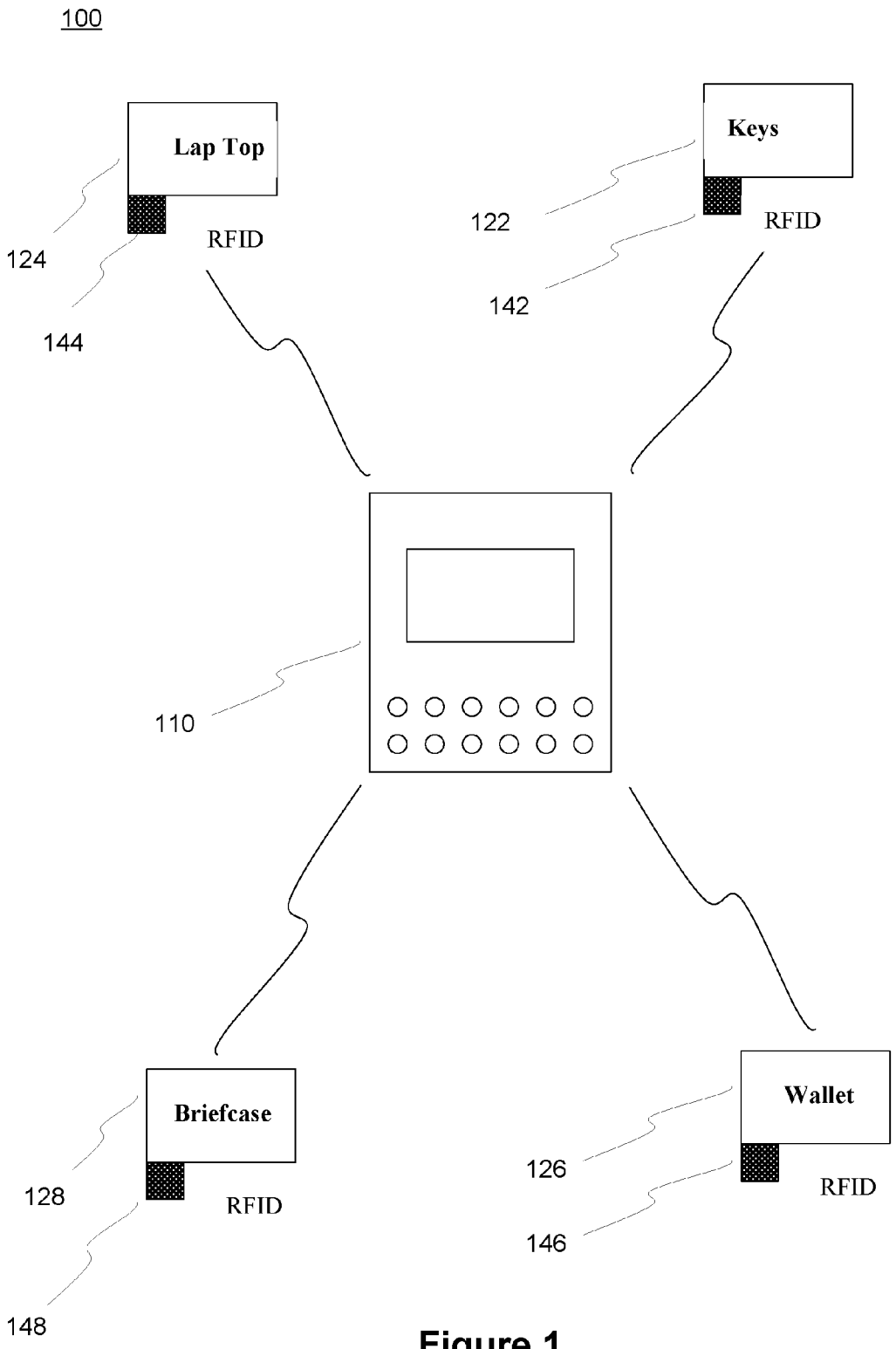
FIG. 1 illustrates a system utilizing radio frequency signals to track items of interest using a computing device.

Reference is now made to FIG. 1, which illustrates a system 100 utilizing radio frequency signals to track items of interest using a computing device. System 100 may include a computing device 110 communicatively coupled to one or more tags 140, each tag 140 adhered to an item 120. As depicted in FIG. 1, tag 142 may be adhered to keys 122, tag 144 adhered to laptop 124, tag 146 adhered to wallet 126, and tag 148 adhered to briefcase 128—collectively tags 140 may be adhered to items 120. As would be apparent to a person having an ordinary skill in the pertinent arts, item 120 may be any item that is benefited from being tracked and that the four example items 120 including keys 122, laptop 124, wallet 126, and briefcase 128 are provided solely as non-limiting examples to increase the understanding and ease of the discussion of the present invention.

Each of tags 140 may contain an RFID. RFID is a technology that provides communication through the use of radio waves to transfer data between computing device 110 and tag 140 attached to each of items 120 for the purpose of identification and tracking. RFID may include passive, active, and/or battery assisted RFID. Passive RFID, includes the use of tags 140 without a battery, may be read as tags 140 pass within close proximity to an RFID reader, such as computing device 110. Active RFID may include a tag 140 with an on-board battery that enables continuous broadcasts of the signal of tag 140. Battery assisted RFID may include a tag 140 with a small battery that is activated when in the presence of an RFID reader, such as computing device 110. Generally, tag 140 may be active, passive or battery assisted. Active tags may have circuitry to store and process received and transmitted data. Tag 140 may include an antenna to receive and transmit an RF signal for communicating with computing device 110. A tag selected to be used in the present system may have a readable bar code on the package. Active tags may provide the ability to transmit an audible tone, such as 20 to 20000 Hz tones, for example. System 100 may prevent the use of tones that are used in telephone systems to identify specific digits, for example. The system may prevent the utilization of identical tones for multiple tags. Passive and battery assisted tags may rely on computing device 110 for detection.

A line of sight is not required to "see" tag 140, so tag 140 may be read inside a case, carton, box or other container. Tags 140 may be read from several meters away and beyond the line of sight of computing device 110. The application of bulk reading enables an almost-parallel reading of tags 140.

Tags 140 may include an integrated circuit for storing and processing information, modulating and demodulating a radio-frequency (RF) signal, and other specialized functions, and an antenna for receiving and transmitting the RF signal. Tags 140 may emit an audible signal based on instructions or a signal from computing device 110. Such a tone may provide information to a user such as when the user is attempting to find a lost/hidden item. Such a tone may be determined by the configuration and/or design of tag 140, or may be based on the signal or method of causing the tone to be emitted, such as by the information included in the signal from computing device 110.

Tags 140 may be concealed or incorporated into items 120 and the size of tag 140 may be as small as 0.05 mm×0.05 mm. Tags 140 may be connected to item or items 120. Tags may be hidden within item 120.

Communication between tags 140 and computing device 110 may occur over radio frequencies, such as 0.125-0.1342, 0.140-0.1485, 13.56, 433 MHz, 840-960 MHz, and 2400-2480 MHz, optical RFID, such as 333 THz (900 nm), 380 THz (788 nm), 750 THz (400 nm). For example, this communication may utilize Bluetooth, Dash7, and/or ZigBee.

Bluetooth is an open wireless technology standard for exchanging data over short distances, using short-wavelength radio transmissions in the ISM band from 2400-2480 MHz, from fixed and mobile devices. Bluetooth uses a radio technology called frequency-hopping spread spectrum, which chops up the data being sent and transmits chunks of it on up to 79 bands (1 MHz each; centered from 2402 to 2480 MHz) in the range 2,400-2,483.5 MHz. Gaussian frequency-shift keying (GFSK) modulation may be used as a modulation scheme. Since the introduction of Bluetooth 2.0+EDR, $\pi/4$-DQPSK and 8DPSK modulation may also be used between compatible devices. Devices functioning with GFSK may operate to provide an instantaneous data rate of 1 Mbit/s, while $\pi/4$-DPSK and 8DPSK schemes, each may provide 2 and 3 Mbit/s respectively. Bluetooth is a packet-based protocol with a master-slave structure with all devices sharing the clock of the master. Packet exchange is based on the basic clock that ticks at 312.5 μs intervals. Two clock ticks make up a slot of 625 μs; two slots make up a slot pair of 1250 μs. In the simple case of single-slot packets the master transmits in even slots and receives in odd slots; the slave, conversely, receives in even slots and transmits in odd slots. Packets may be 1, 3 or 5 slots long but in all cases the master transmits may begin in even slots and the slaves transmit in odd slots. Bluetooth provides a secure way to connect and exchange information between devices.

Dash7 is an open source wireless sensor networking standard for wireless sensor networking, which operates in the 433 MHz unlicensed ISM band. 433.92 MHz penetrates concrete and water, but also has the ability to transmit/receive over very long ranges without requiring a large power draw on a battery. The low input current of typical tag configurations allows for battery powering on coin cell or thin film batteries for up to 10 years. 433.92 MHz is the same as 13.56 multiplied by the number 32, or 2^5th power, which effectively means DASH7 radios can utilize the same antennae used by 13.56 MHz radios including Near Field Communications, FeLiCa, MiFare, and other near-field RFID protocols. DASH7 provides multi-year battery life, range of up to 2 km, low latency for connecting with moving things, a very small open source protocol stack, AES 128-bit public key encryption support, and data transfer of up to 200 kbit/s.

DASH7 supports tag-to-tag communications which, combined with the long range and signal propagation benefits of 433 MHz, makes it an easy substitute for most wireless "mesh" sensor networking technologies. DASH7 also supports sensors, encryption, IPv6, and other features.

ISO/IEC 18000-7:2009 defines the air interface for radio frequency identification (RFID) devices operating as an active RF tag in the 433 MHz band used in item management applications and provides a common technical specification for RFID devices that can be used by ISO technical committees developing RFID application standards. ISO/IEC 18000-7:2009 is intended to allow for compatibility and to encourage inter-operability of products for the growing RFID market in the international marketplace. ISO/IEC 18000-7:2009 defines the forward and return link parameters for technical attributes including, but not limited to, operating frequency, operating channel accuracy, occupied channel bandwidth, maximum power, spurious emissions, modulation, duty cycle, data coding, bit rate, bit rate accuracy, bit transmission order, and, where appropriate, operating channels, frequency hop rate, hop sequence, spreading sequence, and chip rate. ISO/IEC 18000-7:2009 further defines the communications protocol used in the air interface.

ZigBee is a specification for a suite of high level communication protocols using small, low-power digital radios based on an IEEE 802 standard for personal area networks. ZigBee devices are intended to be simpler and less expensive than other WPANs, such as Bluetooth. ZigBee is targeted at radio-frequency (RF) applications that require a low data rate, long battery life, and secure networking. ZigBee has a defined rate of 250 kbps best suited for periodic or intermittent data or a single signal transmission from a sensor or input device. Low power-usage allows longer life with smaller batteries. Mesh networking provides high reliability and more extensive range. ZigBee chip vendors typically sell integrated radios and microcontrollers with between 60 KB and 256 KB flash memory. ZigBee operates in the industrial, scientific and medical (ISM) radio bands; 868 MHz in Europe, 915 MHz in the USA and Australia, and 2.4 GHz in most jurisdictions worldwide. Data transmission rates vary from 20 to 900 kilobits/second.

Communication between tags 140 and computing device 110 may utilize near field communication (NFC) of computing device 110, for example. NFC is a set of short-range wireless technologies, typically requiring a distance of 4 cm or less, which distance may be extended by combining with the use of tag 140. NFC operates at 13.56 MHz and at rates ranging from 106 kbit/s to 848 kbit/s. NFC may include computing device 110 operating as an initiator and tag 140 attached to item 120. Computing device 110 may actively generate an RF field that can power a passive target. This enables tags 140 to take very simple form factors such as tags, stickers, key fobs, or cards that do not require batteries. NFC uses magnetic induction between two loop antennas located within each other's near field, effectively forming an air-core transformer. NFC operates within the globally available and unlicensed radio frequency ISM band of 13.56 MHz. Most of the RF energy is concentrated in the allowed 14 kHz bandwidth range, but the full spectral envelope may be as wide as 1.8 MHz when using ASK modulation.

NFC is an open platform technology standardized in ECMA-340 and ISO/IEC 18092. These standards specify the modulation schemes, coding, transfer speeds and frame format of the RF interface of NFC devices, as well as initialization schemes and conditions required for data collision-control during initialization for both passive and active NFC modes. Furthermore, the standards also define the transport protocol, including protocol activation and data-exchange methods. A common data format called NFC Data Exchange Format (NDEF) may be used to store and transport various kinds of data, ranging from any MIME-typed object to ultra-short RTD-documents, such as URI.

NFC may provide up to 20 cm and supported data rates: 106, 212, 424 or 848 kbit/s. When operating with a passive tag 140, computing device 110 may provide a carrier field and tag 140 may respond by modulating this carrier field. In this mode, tag 140 may draw operating power from the carrier field produced by computing device 110, thus making tag 140 a transponder. When operating with an active tag 120, both computing device 110 and tag 140 may communicate by alternately generating electrical fields.

Computing device 110 may receive and transmit data simultaneously. Thus, computing device 110 may check for potential collisions when the received signal frequency does not match with the transmitted signal's frequency. NFC of computing device 110 may have a shorter range as compared to other wireless methods, and this shorter range may reduce the likelihood of unwanted interception.

Tags 140 may contain data and may be read-only and/or rewriteable. Tags 140 may be custom-encoded by the manufacturers. Once the application of the present invention is resident in computing device 110, computing device 110 may allow the end user to select and enter tags 140 and specify an associated item 120. Once the end user selects a tag 140 from the possible list of tags 140, the bar code reader within computing device 110 may be used to assure that the selected tag is correct. The reading of the bar code on the tag package when compared to the selected entry may provide assurance that the selected tag is correct. If there is a discrepancy, system 100 may reject the entry and restart. As each tag 140 is selected, tag 140 may be secured to an item 120. Once tag 140 has been secured to item 120, a registration of tag 140 and the establishment of RFID device number may be triggered.

System 100 may be capable of monitoring toddlers distance while walking or at an amusement park, generating an alarm if item 120, a toddler, monitored with tag 140, moves away from computing device 110 and vice versa. Similar tracking may be utilized for personal belongings during airport check in, keeping track of items that are considered hidden, keeping track of items that are considered necessary before leaving a location, such as a home, finding items within a given radius from computing device 110 at a specific location, and preventing people with medical issues from wondering from a specific area, by way of non-limiting example only.

Computing device 110 may include a resident application to coordinate and run the tracking of items 120, as well as providing a display of the tracking. Once the application is downloaded to computing device 110, detailed instructions may enable set up of computing device 110 to coordinate communication and monitor items 120. Assurance that all of items 120 and tags 140 are fully functional and being monitored by system 100 may be configured by the application on computing device 110.

Figure 2:
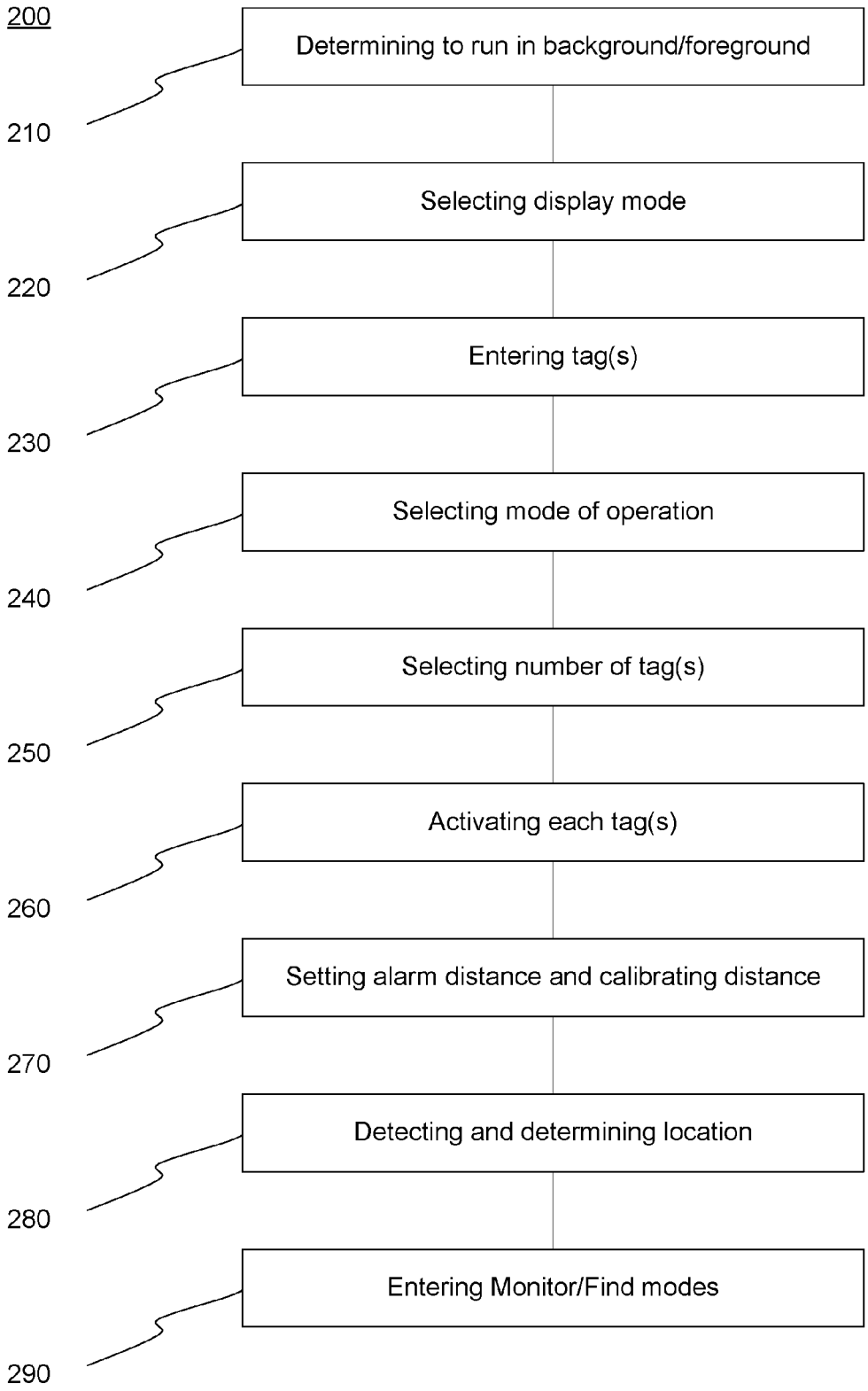
FIG. 2 illustrates a method of the flow of the system of FIG. 1.

Referring now additionally to FIG. 2, there is illustrated a method 200 of the flow of system 100. Method 200 may include a determination of whether to run the application in the background or foreground of computing device 110 at step 210. Running the application in the foreground may allow interruptions of the present system on computing device 110 only with respect to the making and receiving calls on computing device 110. Running the application in the background may allow the present system to be interrupted by all other applications that may be run by computing device 110. When operating in background mode, in case of an alarm, the present system may be switched to the foreground, for example.

Method 200 may include selection of a display mode at step 220. Computing device 110 may track items 120 in a constant or background display mode. Secondary display mode may be associated with tags 140 and thereby items 120 that are considered at fixed locations, such as items 120 located in a closet, drawer, tool box, or the like. Constant display mode may provide computing device 110 with ability to display the relative location of each tag 140 associated with the moving of computing device 110 and tag 140. In order to determine relative position, computing device 110 may be equipped with a tunable input to determine signal strength in each of the quadrants. Alternatively, the relative location may be measured by instructing the user of computing device 110 to turn around (rotate 360 degrees) and record the RF level, such as at each of the quadrants, thus achieving a relative location. Alternatively, a rotating antenna may be utilized in computing device 110 to enable tag locating.

System 100 may provide a compass screen outlining the cardinal points for display on computing device 110. This compass screen may be utilized to inform a user of the location of each tag 140 in the specific mode of operation. Further, each tag 140 may be selected to provide associated text and to provide additional details. The compass screen may be rotated so that the North pointing arrow is in line with magnetic North, for example. Computing device 110 may rely on the internal GPS to synchronize the compass to provide computing device 110 North pointing arrow to be in line with GPS NORTH.

Method 200 may include entering tags 140 at step 230. Entering 230 may include associating each tag with an operation mode, such as find, hide, tracking, and leave home modes, for example. Each entered tag may be assigned a number, such as 1-15, for example, and a text, such as an identifier, for example, to be associated with the entry. In addition each entered tag 140 may be identified with an alarm distance. As each tag is entered, the location of tag 140 may be defined relative to magnetic North so that as computing device 110 is rotated, system 100 may automatically track and update the display for each of the operations.

A mode may be assigned for each of tag 140. For example, tag 140 may be assigned entries that range from 1-15. Each selected tag may also have associated text for a quick identification. This text may be for example up to seven to ten letters in length. Tag 140 may be associated with a mode of operation such as find, hide, leave home, and tracking constant. Once tags 140 have been entered, tags 140 may be arranged for convenience, such as alphabetically, by priority, or the like.

For example, activated tags 140 may be arranged in blocks of five with each block of 5 tags associated with a polling priority, such as maximum, medium and low. The number of times that each block of tags is polled may be reflected in the priority. In this situation, the tags associated with maximum priority may be polled two or three times before moving to the polling of the other blocks of tags. System 100 may set the polling times to assure that the first block of tags is polled more times than the 2nd or 3rd block of tags, and the 2nd block of tags polled more times than the 3rd block of tags, for example. The polling may be controlled or selected by a user. A default polling configuration may be configured by the application.

Figure 3:
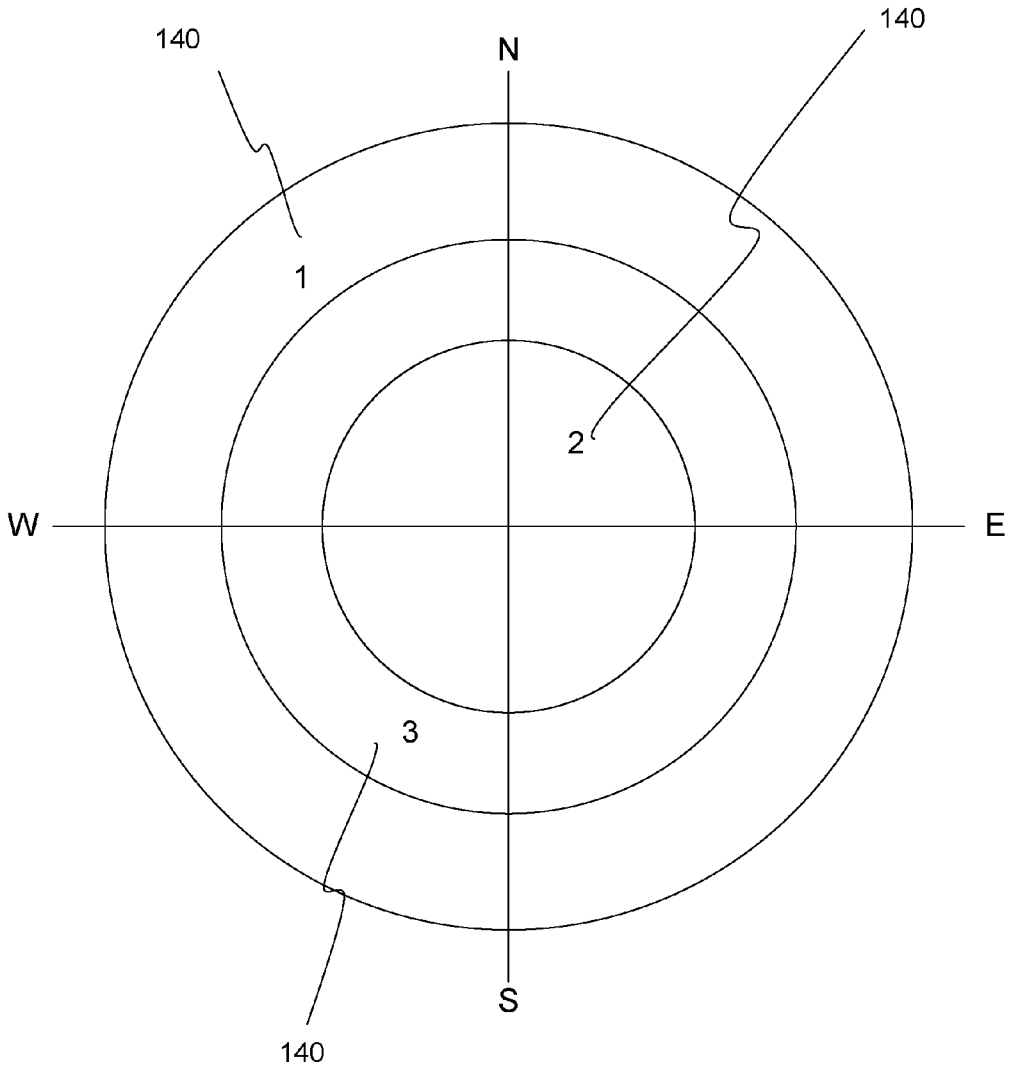
FIG. 3 illustrates a display of the computing device.

Referring now additionally to FIG. 3, there is illustrated a display of computing device 110. The display of computing device 110 may include a display screen similar to a radar screen with each tag 140 displayed with the specified device number (represented as devices 1, 2, and 3 in FIG. 3) and the specified text similar to an air traffic control display, for example. This display may use coordinate (0, 0) to represent computing device 110. Computing device 110 may display a compass feature, including a circle with the cardinal points N, E, S and W. Computing device 110 may be positioned and aligned with magnetic north and computing device 110 may poll each tag 140 and determine the location of each tag 140. Computing device 110 may display the location of tag(s) 140 collectively or in subsets, such as in groups of five. For example, each block of tags 140 may be displayed on the screen and the time for display of each of block may be based on the polling time.

In each of the operating modes, the present application and therefore computing device 110 may determine the location of tags 140 by detecting the direction of the MAX RF level from each tag 140. Computing device 140 may be equipped with multiple receiving antennas each located at 0, 90, 180 and 270 degrees, for example. Each of these antennae may be addressed and each antenna may be selected by activating specified RF switches, for example. Computing device 110 may measure the RF level received by each antenna and determine, such as relative to North, the direction of the highest level tag 140 signal. As each signal is received, the level and location of the signal may be stored to enable the highest level and deviation from magnetic North to be determined and displayed on computing device 110.

Method 200 may include selecting a mode of operation at step 240. The mode of operation may include find, hide, leave home, and tracking, for example. In find mode, system 100 may have the capability to find a lost tag 140 within a given distance from computing device 110. In the find mode, system 100 may incrementally increase the polling distance, such as by varying the RF level of the reader, until maximum working distance is reached in an attempt to locate the lost tag. In find mode, system 100 may have the ability to find tags 140 that are located within a certain radius from computing device 110. The user may select the distance to be utilized for the find mode. The user may select whether constant or background mode is to be shown on the display of computing device 110 during the find mode.

Hide mode may provide system 100 the ability to keep track of tags 140 that were originally associated with hide mode. Once the application is set to hide mode, computing device 110 may record the latitude and longitude of each tag 140 to enable retrieval of each tag as desired. System 100 may require an additional password entry in order to access hide mode. In hide mode, tags 140 associated with hide mode may be retrieved by a recall function. System 100 may indicate the direction to be traveled in order to reach the defined latitude and longitude entry associated with tag 140. Such directions may be provided by the GPS of computing device 110, for example.

Leave home mode may provide system 100 the capability to keep track of tag 140. This mode may be used for tags 140 that are considered necessary for the user when the user leaves home and may be selected as the "leave home mode". When system 100 is placed in "Leave Home Mode," system 100 may poll the list of tags 140 that were selected as necessary for when the end user leaves the home or any other designated location. The designated tags 140 may be monitored to ensure that items 120 to which tags 140 are attached are in fact leaving home as needed. Classifications of tags 140 may be configured such as tags 140 identified as being needed when leaving for work, and tags 140 identified as being needed for vacation. Additional classifications may be provided for places where users of the present system may need items 120. These classifications may include the grocery store, school, the pool, the beach, and the like.

Tracking mode may provide system 100 the capability to keep track of tags 140 that are within a defined or predefined distance of computing device 110. When system 100 is placed in tracking mode, system 100 may poll the list of tags 140 that are designated as in tracking mode and determine the location of each tag 140 to be assured that these tags are within the selected distance range from computing device 110.

Method 200 may include selection of the number of tags 140 at step 250 and activating each tag 140 at step 260. System 100 may be provided the number of tags to be tracked and/or entered and the model number of tag 140 and may determine if the provided model number is in the list of tag model numbers. Each tag 140 may be activated. In order to activate a tag, a tag device number may be created. In system 100, the base of each tag device number may be the telephone number of computing device 110, for example. Once tag 140 is selected, computing device 110 may concatenate three additional digits to telephone number of computing device 110. These concatenated digits may represent modes of operation 1 (1=Find Mode) and the device number that is associated with the particular tag (numbers 1 to 15). By way of non-limiting example only, computing device 110 telephone number and tag device number may be concatenated as computing device Tel number+mode of operation number+device number such as 888-888-8888-101. In this representative example, the selected mode of operation may be represented by 1 and the first tag selected may be device number 01.

System 100 may be configured to automatically increment the device number as each tag is added. The maximum number of selected device IDs may be less than or limited to 15, for example. Although certain embodiments may include 25, 50 or even 100 tags, for example. System 100 may prevent the adding of devices once 15 have been selected, for example. If more than 15 entries have been entered, an alarm, such as an audible tone and/or the displaying of text on computing device 110, may be initiated to inform the end user that the additional devices may not be tracked.

Method 200 may include setting the alarm distance and calibrating the distance at step 270. Step 270 may take an initial configuration with tag 140 a set distance from computing device 110. An audible tone associated with tag 140 may be selected on computing device 110. System 100 may activate this audible tone whenever an alarm is initiated for tag 140. This audible tone may take the form of associating a certain frequency tone to tag 140, such as a 3 KHz tone to the tag 140 representing the wallet, for example. Ringtones may also be used as tones associated with tag 140. System 100 may increase the amplitude of the selected tone as the distance from computing device 110 to tag 140 increases during an alarm event. System 100 may mute the audible tone and display a text alarm on computing device 110 screen. System 100 may be configured by selecting one of the following alarm operating modes from Table 1.

TABLE 1

| Test Condition | Audible Tone | Display |
|---|---|---|
| Alarm is detected | Yes | Yes |
| Alarm is detected | Yes | No |
| Alarm is detected | No | Yes |
| Alarm is detected | No | No |

For example, after each tag 140 is entered into system 100, a calibration may occur at the max safe distance of operation. Whenever system 100 detects that the distance between tag 140 and computing device 110 is greater than originally selected for a given tag 140, an alarm may sound. Tag 140 and/or item 120 may be displayed on the screen of computing device 110. For example, if an alarm is configured to alert a user whenever tag 140 is greater than 5 feet from computing device 110, tag 140 may be calibrated at 5 feet from computing device 110. Further, an alarm event may be triggered if there is a reduction in signal level, rapid changes in RF signal level, drastic changes in received signal angle, loss of signal and if a failure is reported in tag battery status.

Computing device 110 may poll tag 140 and set the distance for the alarm boundary condition. For example, once configured with tag 140 at the boundary position with respect to computing device 110, computing device 110 may record the received signal level from tag 140 and, if during operation the received signal level from tag 140 is lower than this initial reading, computing device 110 may provide the alarm. As would be apparent to those possessing an ordinary skill in the art, instead of a single RF measurement, numerous measurements may be made to provide a statistical sampling to use as a reference RF reading.

The distance between tag 140 and computing device 110 may be determined. For example, if tag 140 is an active tag able to transmit an audible tone as instructed during the calibration process, system 100 may determine the distance by allowing the transmitter of tag 140 to burst an audible tone. The time for the tone to be received may be approximated, such as by calculating the time between when the request to provide the audible burst being sent by computing device 110 until the time when computing device 110 receives the audible tone. Using the following formula:

Distance traveled=Speed*time to travel that distance with the speed of sound as approximately 343 m/s (1,230 km/h; 767 mph), the speed of sound times the time may allow a determination of the distance traveled. In such a configuration, the transmitted packet from tag 140 may take the form of USER Tel number+RFID device number+audible tone frequency, such as 888-888-8888-101-10000, for example.

Method 200 may include detecting and determining the location of a tag 140 at step 280. Detecting and determining of step 280 may be enabled by providing computing device 110 with directional antennas. Computing device 110 may determine the location of tag 140 by monitoring the received signal level from each of the directional antennas. The directional antennas may activate to determine a quadrant direction from where a maximum signal level is located. Computing device 110 may process signals as long as changes are present, such as location and RF level, for example. As each antenna is being activated, computing device 110 may track location, such as using the deviation from North, for example, and compare RF signal levels. Once the maximum RF level is determined, system 110 may determine and update the location of tag 140 and then proceed to the next tag 140 for location determination.

As computing device 110 polls each tag 140, the received RF signal level from each tag 140 for each internal antenna may be utilized to determine the direction of tag 140. The received RF signal level may be utilized to trigger an alarm if the received level translates to a distance greater than the maximum allowable distance. That is, the signal level from each antenna may be utilized to locate tag 140 and the received signal level may be utilized to determine the location of tag 140. Upon completion of polling tags 140, system 100 may indicate the direction from which the maximum signal was received for each tag 140.

Method steps 230-280 may be repeated for any additional or other tags 140 and the associated items 120 that are to be monitored. Steps 230-280 may also be performed in parallel for additional tags. Computing device 110 may track as many as 15 tags 140, for example, for each of the operating modes.

Method 200 may include entering find and/or monitor mode at step 290. The displaying of an alarm and whether to enter monitor tag or find tag modes may be determined.

Figure 4:
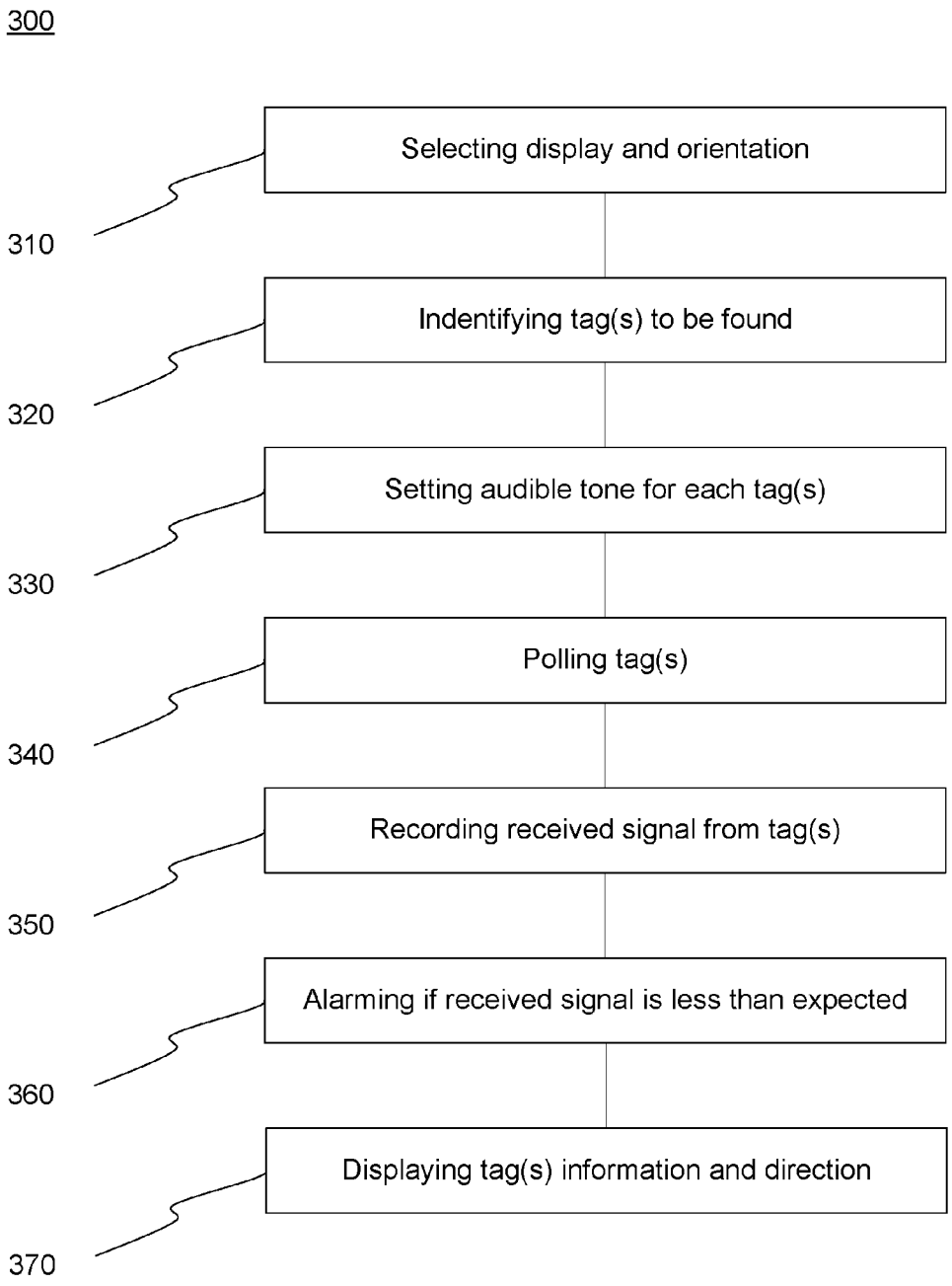
FIG. 4 illustrates a find mode method.

Referring now additionally to FIG. 4 there is illustrated a find mode method 300. Method 300 may include selecting the display and orientation at step 310. Method 300 may identify tag(s) to be found at step 320. Method 300 may include setting the audible tone, such as a specific frequency, ring tone, and/or keypad entry, for each tag(s) at step 330. Further, method 300 may include polling tag(s) at step 330 and recording the received RF signal from tag(s) at step 340. Method 300 may compare the received RF signal on a tag by tag basis and alarm if the received RF signal is less than the RF signal originally measured at step 350. At step 360, method 300 may include displaying tag(s) information and direction.

Figure 5:
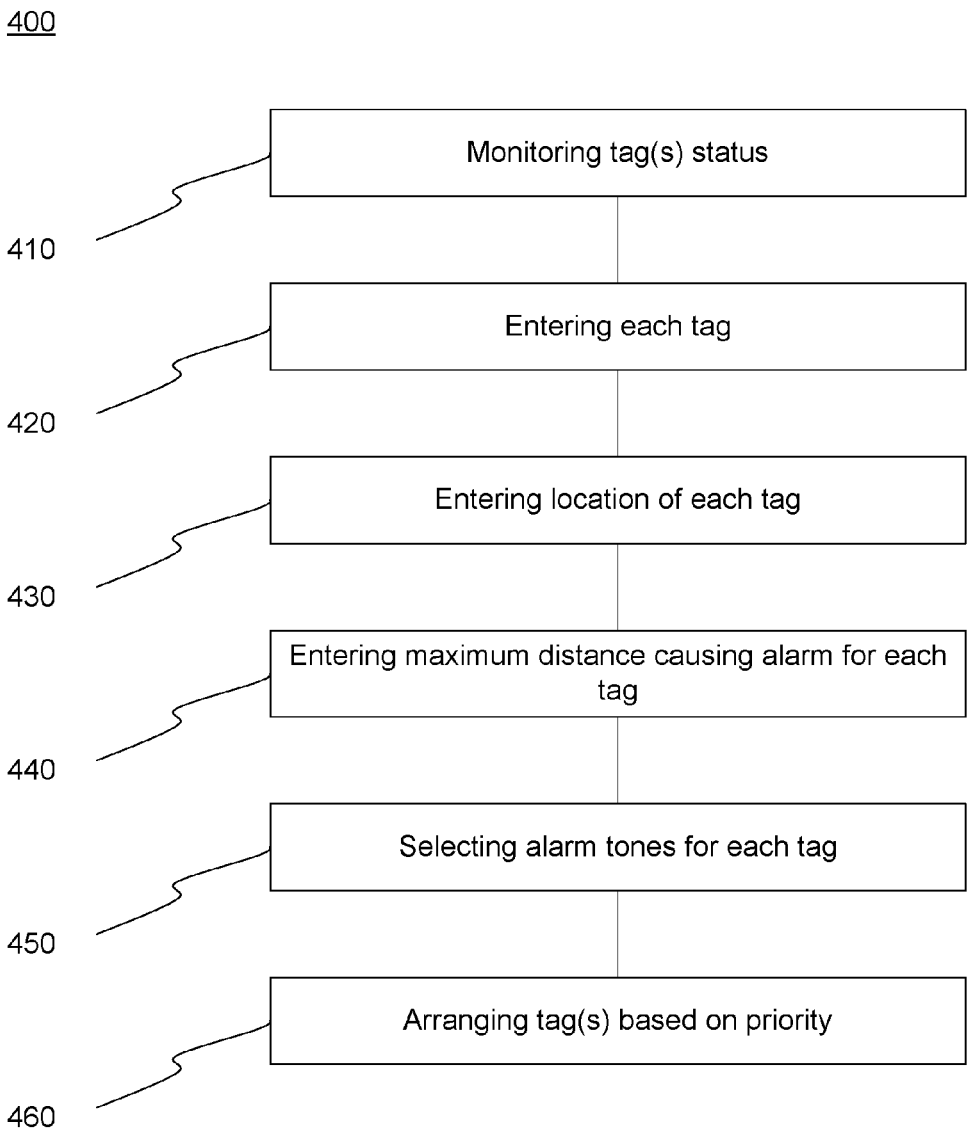
FIG. 5 illustrates a monitor mode method.

Referring now additionally to FIG. 5, there is illustrated a monitor mode method 400. Method 400 may include monitoring tag status at step 410, including battery, RF level, and RFID, for example. Tag 140 may be in communication with computing device 110, and during this communication may provide tag status information, such as device ID, RF level and battery cell status, for example. As part of the RF transmission from tag 140, the RFID battery status may be included. This may include battery status in every transmission, periodic transmissions, or other forms of information conveying as appropriate. Tag 140 may provide a state of health of the embedded battery, time to battery empty, and test conditions for audible tones and display reporting, for example. In monitor mode, entries of each tag 140 for each item 120 may be tracked and entered at step 420. For example, a number, such as 1-15, may be given for each tag and text, such as a message, may be associated with each tag 140. A location associated with tag 140 may be entered at step 430. The maximum distance causing an alarm may be entered for each tag 140 at step 440. Alarm tones for each tag 140 may also be selected at step 450. After all of the entries have been made, tags 140 may be arranged according to priority at step 460. Priorities may include three choices of monitoring priority and each choice may include up of 5 tags, for example.

The present application may be configured to disable or otherwise curtail the application if any interruption in cellular service, such as disabling cellular service to computing device 110, losing or misplacing computing device 110, for example. Disabling or curtailing the application may be initiated by a transmission of a signal, such as a "kill" signal to computing device 110. Alternatively, computing device 110 may activate this disable or curtail mode based on received information, including, but not limited to, a canceled service signal or locate signal from a base station. When the application is disabled or curtailed, the application may be prevented from running as a standalone application.

Figure 6:
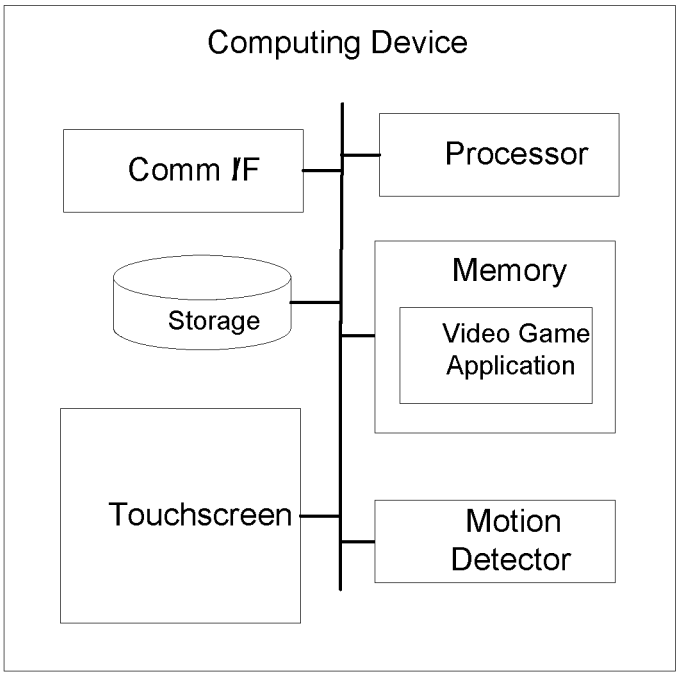
FIG. 6 is a block diagram of a computing device that may be used to implement features described herein.

FIG. 6 is a block diagram of a computing device that may be used to implement features described herein. The computing device includes a processor, a memory device, a communication interface, a data storage device, a touchscreen display, and a motion detector. These components may be connected via a system bus in the computing device, and/or via other appropriate interfaces within the computing device.

The memory device may be or include a device such as a Dynamic Random Access Memory (D-RAM), Static RAM (S-RAM), or other RAM or a flash memory. As shown in FIG. 6, the application, or appropriate web browser, is loaded into the memory device.

The data storage device may be or include a hard disk, a magneto-optical medium, an optical medium such as a CD-ROM, a digital versatile disk (DVDs), or Blu-Ray disc (BD), or other type of device for electronic data storage. The data storage device may store instructions that define the application, and/or data that is used by the application.

The communication interface may be, for example, a communications port, a wired transceiver, a wireless transceiver, and/or a network card. The communication interface may be capable of communicating using technologies such as Ethernet, fiber optics, microwave, xDSL (Digital Subscriber Line), Wireless Local Area Network (WLAN) technology, wireless cellular technology, and/or any other appropriate technology.

The touchscreen display may be based on one or more technologies such as resistive touchscreen technology, surface acoustic wave technology, surface capacitive technology, projected capacitive technology, and/or any other appropriate touchscreen technology.

When the touchscreen receives data that indicates user input, the touchscreen may provide the data to the application. Alternatively or additionally, when the motion detector detects motion, the motion detector may provide the corresponding motion information to the application.

As shown in FIG. 6, the application is loaded into the memory device. Although actions are described herein as being performed by the application, this is done for ease of description and it should be understood that these actions are actually performed by the processor (in conjunction with the persistent storage device, network interface, memory, and/or peripheral device interface) in the computing device, according to instructions defined in the application. Alternatively or additionally, the memory device and/or the data storage device in the computing device may store instructions which, when executed by the processor, cause the processor to perform any feature or any combination of features described above as performed by the application. Alternatively or additionally, the memory device and/or the data storage device in the computing device may store instructions which, when executed by the processor, cause the processor to perform (in conjunction with the memory device, communication interface, data storage device, touchscreen display, and/or motion detector) any feature or any combination of features described above as performed by the application.

The computing device shown in FIG. 6 may be, for example, an Apple iPad, or any other appropriate computing device. The application may run on an operating system such as iOS, Android, Linux, Windows, and/or any other appropriate operating system.

As used herein, the term "processor" broadly refers to and is not limited to a single- or multi-core central processing unit (CPU), a special purpose processor, a conventional processor, a Graphics Processing Unit (GPU), a digital signal processor (DSP), a plurality of microprocessors, one or more microprocessors in association with a DSP core, a controller, a microcontroller, one or more Application Specific Integrated Circuits (ASICs), one or more Field Programmable Gate Array (FPGA) circuits, any other type of integrated circuit (IC), a system-on-a-chip (SOC), and/or a state machine.

As used to herein, the term "computer-readable medium" broadly refers to and is not limited to a register, a cache memory, a ROM, a semiconductor memory device (such as a D-RAM, S-RAM, or other RAM), a magnetic medium such as a flash memory, a hard disk, a magneto-optical medium, an optical medium such as a CD-ROM, a DVDs, or BD, or other type of device for electronic data storage.

Although features are described herein as being performed in a computing device, the features described herein may also be implemented, mutatis mutandis, on a desktop computer, a laptop computer, a netbook, a tablet, a cellular phone, Smartphone, a personal digital assistant (PDA), or any other appropriate type of computing device or data processing device.

Although features and elements are described above in particular combinations, each feature or element can be used alone or in any combination with or without the other features and elements. For example, each feature or element as described above may be used alone without the other features and elements or in various combinations with or without other features and elements. Sub-elements of the methods and features described above may be performed in any arbitrary order (including concurrently), in any combination or sub-combination.

Although the invention has been described and pictured in an exemplary form with a certain degree of particularity, it is understood that the present disclosure of the exemplary form has been made by way of example, and that numerous changes in the details of construction and combination and arrangement of parts and steps may be made without departing from the spirit and scope of the invention as set forth in the claims hereinafter.

What is claimed is:

1. A system for tracking at least one item, the system comprising:

a computing device capable of near field communication (NFC) and including a radio frequency identification (RFID) transceiver; and at least one tag coupled to each of the at least one item, the at least one item having a communication prioritization associated therewith, the at least one tag communicatively coupled to the computing device using radio frequency (RF) signals, wherein the at least one tag is polled by the computing device, said polling comprising the transceiver communicating with the at least one tag in accordance with the polling priority of the at least one tag, said polling priority derived from the communication prioritization associated with the at least one item;

wherein the coupling of the at least one tag to the at least one item enables the computing device to identify the at least one item and the distance from the at least one item to the computing device.

2. The system of claim 1 wherein the at least one tag is passive.

3. The system of claim 1 wherein the at least one tag is active.

4. The system of claim 1 wherein the distance between the at least one item and the computing device is compared to a maximum distance and an alarm is triggered if the distance is greater than the maximum distance.

5. The system of claim 1 wherein the computing device is equipped with multiple receiving antennas.

6. The system of claim 1 wherein the computing device displays a radar screen displaying the at least one item and the direction and location with respect to the computing device.

7. The system of claim 6 wherein the radar screen comprises a compass and cardinal points.

8. The system of claim 1 wherein the RF signals comprise Bluetooth.

9. The system of claim 1 wherein the RF signals comprise Dash7.

10. The system of claim 1 wherein the RF signals comprise ZigBee.

11. A system for tracking items, the system comprising:

a communication interface configured to interact with at least one tag using radio frequency signals and an RFID transceiver, the at least one tag being coupled to at least one item to be tracked;

memory that associates the at least one tag and the at least one item to which the at least one tag is coupled;

a processor configured to associate a communication prioritization with the at least one item, to derive a polling priority for the at least one tag from the associated communication prioritization, and to identify the at least one tag and the distance from the at least one tag to the interface at least from the interaction on the interface, and based on polling the memory identifies the at least one item and the distance from the at least one item to the interface, said polling comprising the RFID transceiver communicating with the at least one tag in accordance with the derived polling priority of the at least one tag.

12. The system of claim 11 further comprising a display that displays a radar screen displaying the at least one item and the direction and location with respect to the interface.

13. The system of claim 11 further comprising a speaker that emits a user programmable single frequency audible tone based on the at least one tag.

14. The system of claim 13 wherein the volume of the audible tone increases as the distance between the at least one tag and the interface increases.

15. The system of claim 13 wherein the audible tone is assigned to the at least one tag to represent the at least one item.

16. The system of claim 11 further comprising a locator that associates a latitude and longitude with the at least one tag.

17. A method for tracking at least one item on a computing device, the method comprising:

associating at least one tag with the at least one item and identifying a communication prioritization of the at least one item;

entering at least one tag associated with the at least one item into computing device, wherein the at least one tag is communicatively coupled to the computing device using radio frequency (RF) signals;

deriving a polling priority of the at least one tag from the communication prioritization of the at least one item;

selecting the mode of operation for the entered at least one tag;

activating the at least one tag;

setting and calibrating the alarm distance for the activated at least one tag; and polling the at least one tag to detect and determine the location and direction of the at least one tag with the computing device, wherein the coupling of the at least one tag to the at least one item enables the computing device to identify the at least one item and the distance from the at least one item to the computing device, said polling comprising a transceiver communicating with the at least one tag in accordance with the polling priority of the at least one tag.

18. The method of claim 17 further comprising comparing the distance between the at least one item and the computing device with a maximum distance and triggering an alarm if the distance is greater than the maximum distance.

19. The method of claim 17 further comprising displaying the at least one item and the direction and location of the at least one item with respect to the computing device.

20. The method of claim 17 further comprising emitting a user programmable single frequency audible tone based on the at least one tag.

21. The method of claim 17 further comprising locating the at least one tag in latitude and longitude.

22. The method of claim 17 wherein the computing device performs the method in the background.

23. A non-transitory computer-readable medium having processor-executable instructions stored thereon which, when executed by at least one processor, will cause the at least one processor to perform tracking at least one item on a computing device, the method comprising:

associating at least one tag with the at least one item and identifying a communication prioritization of the at least one item;

entering at least one tag associated with the at least one item into the computing device, wherein the at least one tag is communicatively coupled to the computing device using radio frequency (RF) signals;

deriving a polling priority of the at least one tag from the communication prioritization of the at least one item;

selecting the mode of operation for the entered at least one tag;

activating the at least one tag;

setting and calibrating the alarm distance for the activated at least one tag; and polling the at least one tag to detect and determine the location and direction of the at least one tag with the computing device, wherein the coupling of the at least one tag to the at least one item enables the computing device to identify the at least one item and the distance from the at least one item to the computing device, said polling comprising a transceiver communicating with the at least one tag in accordance with the polling priority of the at least one tag.

24. The computer-readable medium of claim 23 further comprising comparing the distance between the at least one item and the computing device with a maximum distance and triggering an alarm if the distance is greater than the maximum distance.

25. The computer-readable medium of claim 23 further comprising displaying the at least one item and the direction and location of the at least one item with respect to the computing device.

26. The computer-readable medium of claim 23 further comprising emitting a user programmable single frequency audible tone based on the at least one tag.

27. The computer-readable medium of claim 23 further comprising locating the at least one tag in latitude and longitude.

* * * * *